United States Patent [19]

Oplt et al.

[11] 4,428,320

[45] Jan. 31, 1984

[54] REFLECTIVE PAVING MARKER

[75] Inventors: David W. Oplt, Belleville, Ill.; Fred G. Peil, St. Louis, Mo.

[73] Assignee: Lukens General Industries, Inc., St. Louis, Mo.

[21] Appl. No.: 271,416

[22] Filed: Jun. 8, 1981

[51] Int. Cl.[3] ..... E01F 9/06

[52] U.S. Cl. ..... 116/63 R; 404/14

[58] Field of Search ..... 116/63 P, 63 R; 404/11, 404/12, 14, 16; 350/97; 40/612

[56] References Cited

U.S. PATENT DOCUMENTS

| | | | |
|---|---|---|---|
| 3,332,327 | 7/1967 | Heenan | 404/16 |
| 4,040,760 | 8/1977 | Wyckoff | 40/612 X |
| 4,129,397 | 12/1978 | Eigenmann | 404/14 |
| 4,236,788 | 12/1980 | Wyckoff | 404/14 X |
| 4,317,617 | 3/1982 | Charlton | 116/63 P X |
| 4,340,319 | 7/1982 | Johnson et al. | 404/16 |

FOREIGN PATENT DOCUMENTS

| | | | |
|---|---|---|---|
| 2429640 | 1/1975 | Fed. Rep. of Germany | 404/16 |

*Primary Examiner*—Gerald Goldberg

*Assistant Examiner*—Brian Tumm

*Attorney, Agent, or Firm*—Rogers, Eilers & Howell

[57] ABSTRACT

An inexpensive reflective paving marker, which may be used to delineate traffic lanes in construction zones, and is especially useful at night and during wet conditions, has a light weight molded plastic support structure and a reflective element composed of a thin strip of reflective polycarbonate tape. The tape is placed on a surface that is inclined to reflect incident light, such as the light from automobile headlights. The surface on which the reflective tape is mounted has a slight recess to protect the tape from the abrasive effects of traffic, such as automobile tires, to retain the reflective properties of the structure. The support structure has recesses in the bottom which provide additional grip in an adhesive, such as an epoxy or a butyl sheet, which secures the structure in place. Nails or other fasteners may also be used to secure the marker; the support structure has preformed guide holes for fasteners. The structure may also be used as a temporary or a semi-permanent reflective marker on construction barriers, machinery or other equipment, as well as being used on a roadway surface.

10 Claims, 5 Drawing Figures

REFLECTIVE PAVING MARKER

BACKGROUND AND SUMMARY OF THE INVENTION

Light reflecting elements are frequently used as markers for roadways and on other structures. Reflected light is an especially good night marker. U.S. Pat. Nos. 1,906,655, 2,991,698 and 3,332,327 disclose typical devices which have been used. The disclosures of the above patents are incorporated by reference herein. Typical of the prior devices is the molded plastic reflector having a prismatic (cube corner) lens and a reflectorized backing. This structure is expensive to manufacture, requiring a complex mold, and also in requiring a fairly acute incident angle between the face of the marker and the paving surface. The acute angle is required so that traffic, such as vehicle tires moving across the marker, can wipe the accumulated dirt and debris off of the reflecting surface to keep it effective at reflecting light. This has the result of requiring a much greater area in the reflecting surface, since the projected area available to receive incident light, for example from automobile headlights, is reduced considerably due to the angle of inclination of the surface.

Applicant is able to make a highly effective and inexpensive reflective marker, which may be used as a temporary and a semi-permanent marker, by utilizing a very light weight, simple and inexpensive molded support structure and a reflecting element of a thin strip of reflectorized tape bonded to a face on the support structure. The support can be readily fastened to a roadway or other structure by an adhesive, or other fasteners, such as nails, forming a durable mounted element. The structure can be readily removed, when desired, for example, by breaking the adhesive bond. An adhesive can also be used to join the reflective tape to the support structure.

The slick surface of the reflectorized tape resists accumulation of dirt and debris and maintains the bright reflective properties of the structure. At the same time the structure is designed so that there is a minimum of inclination on the reflectorized surface. Essentially all of the reflectorized surface is used to reflect back light, thus allowing a much smaller reflectorized surface area to be used.

The support structure has protecting projections which extend beyond the adhesive surface of the reflectorized tape and beyond the outer reflecting surface as well, so that the reflectorized tape is actually protected from the effects of traffic and will not be marred or inadvertently removed, for example, by contact with vehicle tires.

The invention will be more fully understood and appreciated in the following detailed Description of the Drawings and in the Description of the Preferred Embodiments.

DESCRIPTION OF THE PREFERRED EMBODIMENTS

Figure 1:
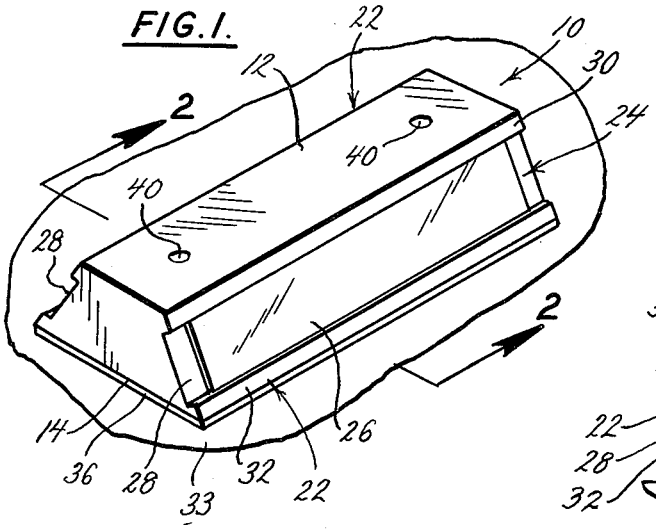
FIG. 1 is an isometric view of the marker of the invention installed on a surface.

Referring in more detail to the drawings, a marker 10 suitable for temporary and semi-permanent use is shown in FIG. 1. The body 12 of the marker 10 is in the general shape of a rectangular prism. The body 12 may be formed by injection molding a material, such as high density polypropylene. Other equivalent plastics and other materials may be used. The body 12 is essentially hollow and open on one side 14, as shown. The body 12 has a reinforcing web 16 extending longitudinally of the body and transverse reinforcing webs 18. One web 16 is shown, but plural longitudinal webs may be used, if desired, particularly if increased strength is required. The webs 16 and 18 increase the strength and rigidity of the body 12 while using a minimum of material and providing a light weight structure. In addition, the webs 16 and 18 form honeycomb like recesses or cells 20 in the body 12. The cells 20 provide a structure for increasing the adhesive bond between the marker 10 and a surface, as described further herein.

The body 12 of the marker 10 may be colored, for example to assist its function. It is anticipated that the marker 10 will be used in at least two colored forms, a white form and a yellow form used for pavement marking. Other colored forms may be used for other types of service. The color desired for paving marking is determined by whether the marker will be used to mark a yellow no-crossing line or in a white line such as a pavement center line or lane marker. White bodied markers 10 are used on white lines and yellow markers are used on yellow lines. The coloring for the marker 10 is provided by suitable dyes and lakes which are compatible with the plastic material chosen for the marker 10. The selection of suitable combinations of conventional dyes or lakes, as well as fillers, extenders and additives for the marker 10 can be readily accomplished by those skilled in the plastic molding art.

Figure 2:
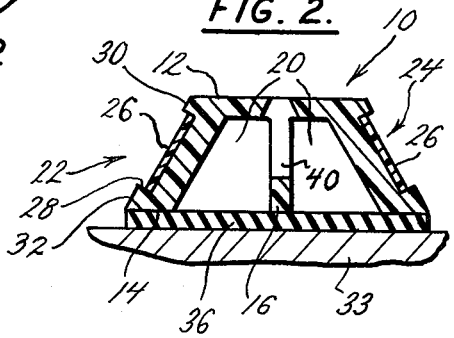
FIG. 2 is a cross-sectional view of the marker taken along the plane 2—2 of FIG. 1.

Referring more particularly to FIG. 2, side 22 of marker 10 is shown. Side 22 is shown inclined slightly from the vertical, as will typically be the case. The angle of inclination to the vertical is small and will normally be between 5° and 15°. We have found that 12° is about optimum. The small angle of inclination allows incident light, for example, from automobile headlights, to strike reflecter 24, on side 22, at approximately a 90 degree angle. As a result, substantially all of the area of reflector 24 is used to collect and reflect back light. The result is a brighter, more effective marker.

Reflector 24 is formed from a strip of reflectorized sheet or tape 26 and is attached to marker 10 by an adhesive, in a conventional manner. The sheet or tape 26 may be of a conventional reflective sheeting or film material, as is commonly used on highway signs. However, applicant prefers that a polycarbonate reflective tape, of the type manufactured by the Reflexite Corporation of New Britain, Conn., under the trademark REFLEXITE, be used. This material has extremely high reflectivity and has a very slick surface which resists accumulation of adhesive dirt and debris. In addition, the material comes prepared in rolls with a high strength adhesive which is protected by a strip sheet until use.

Sides 22 of marker 10 have a recess 28 which retains and protects the tape 26. Recess 28 is formed by two projecting lips, 30 and 32, which extend outwardly from sides 22, as shown. Lips 30 and 32 extend outwardly a distance greater than the thickness of tape 26, so that tape 26 is protected from abrasive contact, for example, with moving vehicle wheels. As a result, the reflective properties of tape 26 are not impaired by scratches and abrasions and tape 26 is not inadvertently removed from the body 12 of the marker 10.

The very steep angle of sides 22 also assist in keeping the surface of tape 26 from becoming marred. The steep angle provides a rather short bump which in effect bounces or hops a vehicle wheel over the tape 26, rather than providing a gradual ramp which would lead the traffic up the surface of tape 26.

FIGS. 1–5 show marker 10 as having two sides 22 on which reflectors 24 are mounted. It will be appreciated, however, that for some purposes a marker having a reflector on only one side would be desired. In addition, plural reflector markers having more than two reflective sides would be required in some instances. For example, markers used in intersections might have three, four or more sides.

Figure 3:
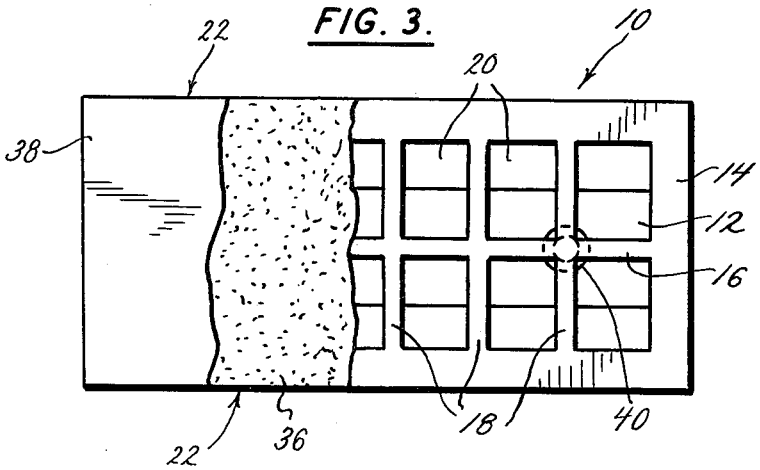
FIG. 3 is a bottom plan view, in partial section of a marker of the invention.
Figure 4:
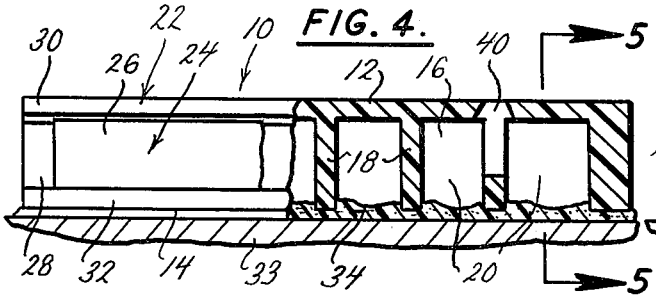
FIG. 4 is a front view, in partial section, of a marker of the invention installed on a surface.
Figure 5:
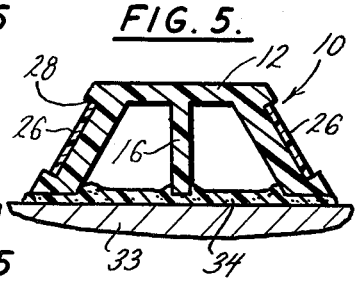
FIG. 5 is a cross-sectional view of the marker taken along the plane 5—5 of FIG. 4.

The marker 10 can be installed on a surface 33, for example, using an epoxy adhesive 34, such as a two part catalytic set adhesive, which can be prepared on site. See FIGS. 4 and 5. Alternatively, a pressure-sensitive butyl adhesive 36 can be used, as shown in FIGS. 2 and 3. The butyl adhesive 36 can be preformed and applied to the marker 10, as a sheet, at the place of manufacture. The marker 10, with the butyl adhesive 36 applied thereto can be transported and stored prior to use. A strip sheet 38, shown in FIG. 3, protects the adhesive 36 until the marker is ready to be installed. It will be appreciated that other adhesive materials, e.g., neoprenes, contact adhesives and the like may also be used if desired. The honeycomb structure of marker 10, having the recessed cells 20 aids in providing a firm adhesive bond between a surface 33 and the marker 10. The marker 10 can be forced into the adhesive, before it has set, as shown in FIGS. 4 and 5. The additional area of marker 10 in contact with the adhesive and the bracing effect behind webs 16 and 18 provide a much tighter bond.

As shown in FIGS. 1–3, the marker 10 may be provided with preformed guide holes 40. The guide holes 40 are shown as being tapered holes extending about two thirds of the distance through the body 12 of marker 10. Guide holes 40 may be used to join the marker 10 to a suitable surface 33, such as a roadway, by nails. In addition, guide holes 40 may be used with bolts, screws or other fasteners to attach marker 10 to construction barriers or other equipment, as desired.

The above description is provided by way of illustration only. It will be appreciated, by one skilled in the art, that modifications and variations can be made in the details of the design and construction without departing from the spirit and scope of the invention as defined in the appended claims. The invention is to be limited only to the scope of the claims which are appended hereto.

We claim:

1. A light weight reflective marker having a substantially prismatic form and having a reflective surface on at least one side, the side having an angle of inclination of between about 5° to 15° to the vertical so that incident light impinges on the reflective surface at substantially 90°, the reflective surface being a piece of reflectorized tape secured to the side of the marker by an adhesive, the reflectorized tape having a polycarbonate outer surface which resists accumulation of adhesive dirt over the reflectorized tape, wherein a substantial portion of the reflective marker is available and effective to reflect back incident light and remains effective in use.

2. The marker of claim 1 wherein the marker has a horizontal projection spaced at a vertical location above the reflective surface and extending transversely beyond the reflective surface and protecting the reflective surface from abrasive contact.

3. The marker of claim 1 wherein the marker has a plurality of reinforcing webs forming a plurality of honeycomb like cavities opening to the bottom surface of the marker, the cavities forming means to assist adhesive bonding of the marker to a roadway or other surface on which it is mounted.

4. A light weight reflective marker having a substantially prismatic form and having a reflective element on at least one side, the side having an angle of inclination of between about 5° to 15° to the vertical so that incident light impinges on the reflective element at substantially 90°, the reflective element being formed of a piece of reflectorized tape secured to the side of the marker by an adhesive, the reflectorized tape having a polycarbonate outer surface which resists accumulation of adhesive dirt over the reflectorized tape, whereby a substantial portion of the reflective marker is available and effective to reflect back incident light and remains effective in use, the marker having a means extending beyond the outer extremity of the reflective element and protecting the surface of the reflective element from abrasive contact so that the reflective property of the reflective element is protected from damage by scratching and abrasive contact.

5. The marker of claim 4 wherein the marker is formed of a hollow molded plastic body having a reinforcing web extending vertically within the body and wherein the marker has a bottom surface, the bottom surface having an adhesive material thereon for attaching the marker to a supporting area.

6. The marker of claim 4 wherein the marker has a plurality of reinforcing webs forming a plurality of honeycomb-like cavities opening to the bottom surface of the marker, the cavities forming means to assist adhesive bonding of the marker to a roadway or other surface on which it is mounted.

7. The marker of claim 4 wherein the protecting means includes a first horizontal projection on the side of the marker spaced at a vertical location above the reflective element and extending transversely beyond the reflective element and a second horizontal projection on the side of the marker and adjacent to the lower edge of the reflective element, the second projection extending transversely outwardly from the marker beyond the reflective element, the projections extending substantially longitudinally of the marker and being substantially parallel to the reflective element, the first and second projections protecting the outer extremity of the reflective element from being marred by abrasive contact and preserving the reflective properties of the reflective element.

8. The marker of claim 4 wherein the marker has additional means formed therein for joining to a roadway or other surface on which it is mounted by the use of nails or other fasteners.

9. The marker of claim 4 wherein the marker has a plurality of reflective elements.

10. A light weight reflective marker having a substantially prismatic form and having a reflective surface on at least one side and wherein the reflective surface is formed of a thin film of reflectorized polycarbonate material adhered to the side of the marker by an adhesive, the side of the marker having an angle of inclination to the vertical of between about 5° to 15°, the angle being such that incident light from a light source, such as automobile headlights, impinges on the reflective surface at substantially 90° when the reflective surface is placed on a base, such as a roadway, the outer extremity of the reflectorized polycarbonate material being extremely slick and resistant to the adhesive accumulation of dirt and grime to maintain and preserve the reflective properties of the reflective film; the marker being formed of a molded plastic material forming a structure having an interior hollow body cavity, the marker being reinforced by at least one longitudinally extending vertical web in the interior cavity of the marker and at least one transversely extending vertical reinforcing web in the interior cavity of the marker, the reinforcing webs forming a plurality of honeycomb like cavities forming means assisting the adhesive bonding of the marker to a roadway or other surface on which it is mounted; the marker having a first projection on the side of the marker and adjacent to an upper edge of the reflectorized polycarbonate film, the first projection extending outwardly beyond the outer extremity of the surface of the polycarbonate film, the first projection extending longitudinally of the marker and being substantially parallel to the upper edge of the polycarbonate film, the marker having a second projection on the side of the marker and adjacent to a lower edge of the reflectorized polycarbonate film, the second projection extending outwardly from the marker beyond the outer extremity of the surface of the polycarbonate film, the second projection extending substantially longitudinally of the marker and being substantially parallel to the lower edge of the polycarbonate film, the first and second projections protecting the outer extremity of the reflectorized film from being marred by abrasive contact and preserving the reflective properties of the reflectorized film.

* * * * *